US005109832A

United States Patent [19]

Proctor et al.

[11] Patent Number: 5,109,832

[45] Date of Patent: May 5, 1992

[54] METHOD OF AND APPARATUS FOR PRODUCING ALTERNATING PRESSURE IN A THERAPEUTIC DEVICE

[76] Inventors: Richard D. J. Proctor, 5 Rocky Hill Dr., Litchfield, N.H. 03051; Robert B. Scheuhing, 16 Spaulding Dr., Merrimack, N.H. 03054

[21] Appl. No.: 623,369

[22] Filed: Dec. 7, 1990

[51] Int. Cl.[5] ..... A61H 1/00; F15C 1/08

[52] U.S. Cl. ..... 128/24 R; 128/64; 137/826; 137/840; 137/624.14

[58] Field of Search ..... 128/24 R, 64, DIG. 20, 128/38; 137/826, 840, 624.14, 814

[56] References Cited

U.S. PATENT DOCUMENTS

| | | | |
|---|---|---|---|
| 3,177,866 | 4/1965 | Wesslund | 128/24 R |
| 3,302,398 | 2/1967 | Taplin et al. | 137/826 X |
| 3,568,702 | 3/1971 | Dustin | 137/826 X |
| 3,703,633 | 11/1972 | Hanada et al. | 137/840 |
| 3,771,174 | 11/1973 | Wortman | 137/826 X |
| 3,862,629 | 1/1975 | Rotta | 128/24 R |
| 3,885,554 | 5/1975 | Rakwell, Jr. | 128/24 R |
| 3,901,221 | 8/1975 | Nicholson et al. | 128/24 R |
| 3,942,518 | 3/1976 | Tenteris et al. | 128/24 R |
| 4,186,732 | 2/1980 | Christoffel | 128/24 R |
| 4,311,135 | 1/1982 | Bruecknet et al. | 128/24 R |
| 4,338,923 | 7/1982 | Gelfer et al. | 128/24 R |
| 4,370,975 | 2/1983 | Wright | 128/64 |
| 4,577,626 | 3/1986 | Marukawa et al. | 128/64 |
| 4,583,522 | 4/1986 | Aronne | 128/24 R X |
| 4,648,427 | 3/1987 | Fruechte et al. | 137/826 |
| 4,738,249 | 4/1988 | Linman et al. | 128/64 X |
| 4,841,956 | 6/1989 | Gardner et al. | 128/64 |
| 4,865,020 | 9/1989 | Ballard | 128/24 R X |
| 4,867,140 | 9/1989 | Hovis et al. | 128/24 R |
| 4,986,260 | 1/1991 | Iams et al. | 128/24 R |
| 4,989,589 | 2/1991 | Pekanmaki et al. | 128/24 R X |
| 5,014,681 | 5/1991 | Neeman et al. | 128/24 R X |
| 5,031,604 | 7/1991 | Dye | 128/24 R X |
| 5,035,361 | 7/1991 | Stouffer | 137/826 X |

*Primary Examiner*—Richard J. Apley
*Assistant Examiner*—Linda C. M. Dvorak
*Attorney, Agent, or Firm*—Wigman & Cohen

[57] ABSTRACT

A method of and apparatus are disclosed for producing alternating pressure in a therapeutic device used to apply compressive forces to a portion of a human body to enhance venous blood flow and prevent venous thrombosis and pulmonary embolism in surgical patients. The apparatus comprises at least two sets of a plurality of inflatable bladders or chambers arranged in alternating relation to one another. All the bladders of one set are inflated and deflated alternately with the deflation and inflation of all the bladders of the other set to produce a therapeutic alternate chamber pumping action on that portion of the body being treated. A single fluidic flip-flop device controls the supply and venting of pressurized fluid to and from the chambers.

20 Claims, 4 Drawing Sheets

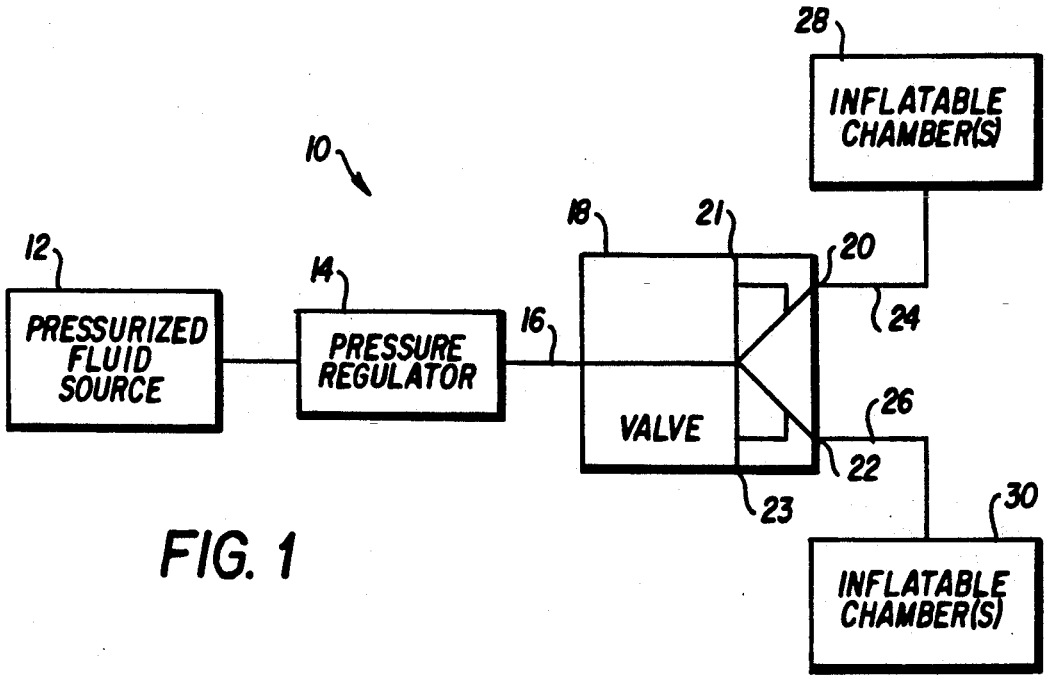
FIG. 1
FIG. 5
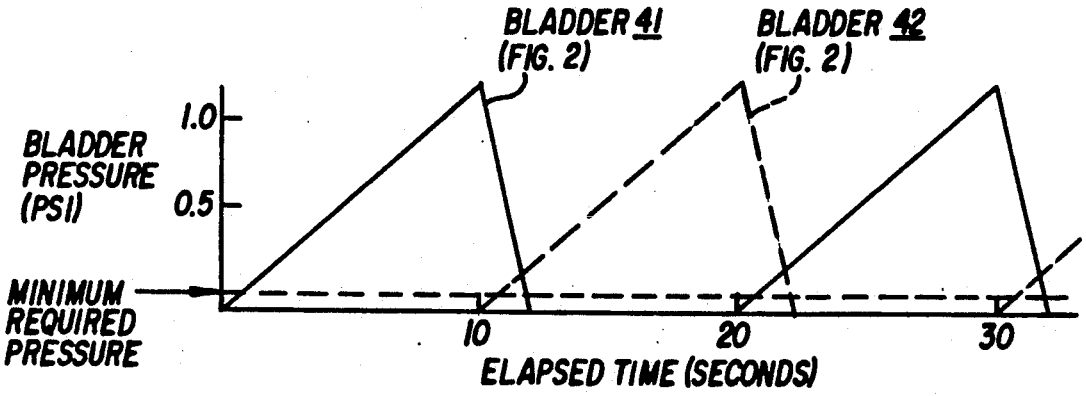

FIG. 3
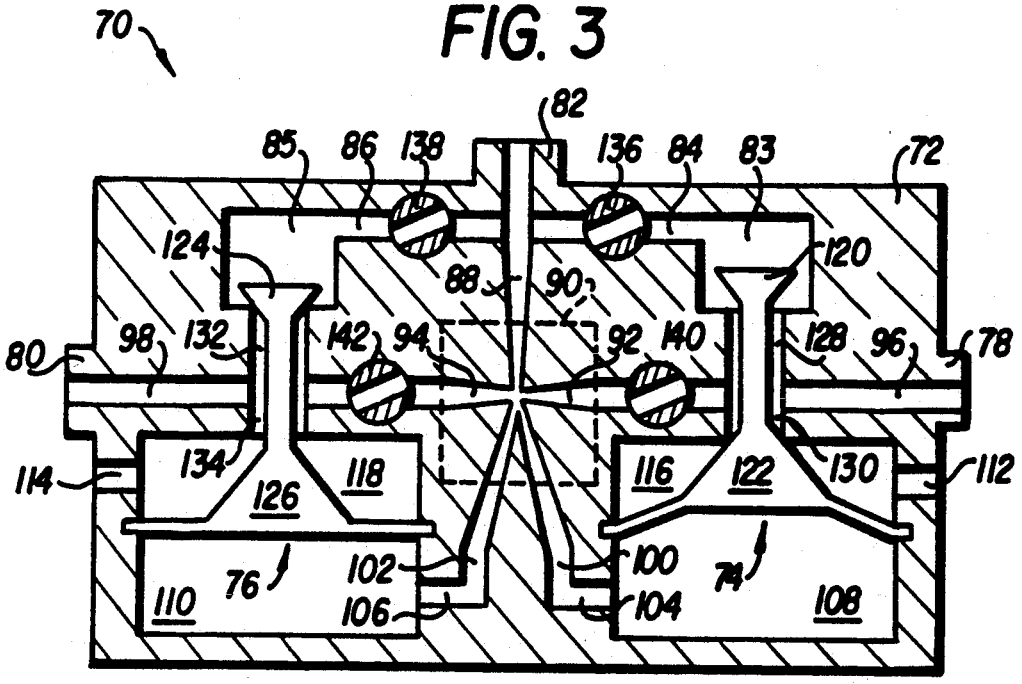
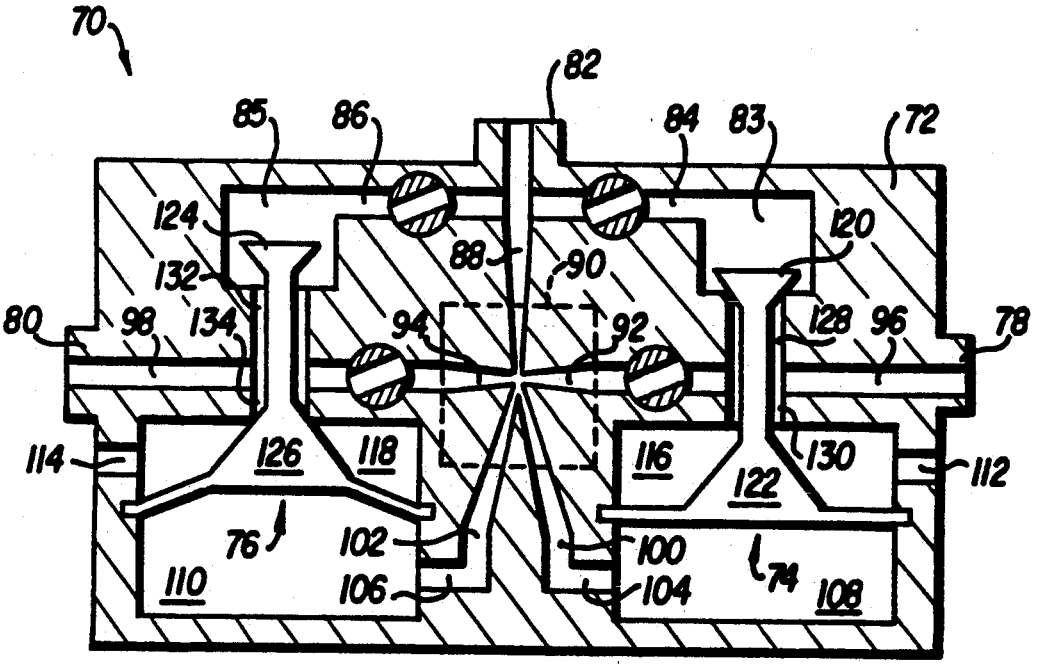
FIG. 4

METHOD OF AND APPARATUS FOR PRODUCING ALTERNATING PRESSURE IN A THERAPEUTIC DEVICE

FIELD OF THE INVENTION

The present invention relates to medical apparatus and methods and more particularly to a non-invasive method of and apparatus for producing alternating pressures in a device used to apply compressive forces to a portion of a body for the therapeutic purpose of enhancing venous blood flow to prevent venous thrombosis and pulmonary embolism in surgical patients.

DESCRIPTION OF THE PRIOR ART

In the prevention of venous thrombosis in surgical patients, it is well known that intermittent application of pressure to the lower extremities significantly reduces the occurrence of deep vein thrombosis which can lead to pulmonary embolism. Many prior art devices have been proposed for applying intermittent pressure to body extremities, especially the legs, by means of one or more inflatable bladders or cuffs disposed about the legs of a patient. The bladders are then periodically inflated with air or another fluid at a predetermined frequency. Typical of such devices is that disclosed in U.S. Pat. No. 2,140,898 which requires a source of electricity for operation.

In addition to the prior art devices which apply a uniform intermittent pressure to an extremity by means of one or more bladders or cuffs, therapeutic devices are also known for applying pressure to an extremity in a peristaltic or quasi-peristaltic manner by the sequential inflation of a series of annular bladders arranged about the limb and spaced along the length thereof. One such known device is disclosed in U.S. Pat. No. 3,862,629. That device requires a plurality of series-connected bladders which, after attaining steady state operation, operate in a quasi-peristaltic mode and apply substantially sinusoidal compressive forces to the limb of the patient. Because an individual valve assembly is used with each bladder, as many as twenty valve assemblies are required for a single therapeutic device thereby making the device quite costly to produce. In addition, the valve assemblies of this prior art device are constructed with a number of surfaces which are in sliding or frictional contact. In view of the relatively low operating pressures (1–2 psi), and the series connection of the valve assemblies, a single sticking or marginally operative valve assembly could diminish the therapeutic effectiveness of the device or possibly interrupt operation of the device altogether, thereby rendering the device useless. Moreover, because of the series connection of the valve assemblies, stable operation of the device is not achieved until the fluid pressure serially inflates all the bladders which may take one minute or more depending on the number of valve assemblies connected in series and the inflation period of the valve assemblies.

U.S. Pat. Nos. 3,885,554 and 3,942,518 disclose devices which utilize fluidic technology to control the periodic inflation and deflation of the bladders in therapeutic devices of the above-described type. While such fluidic controlled devices effectively eliminate the need for a source of electrical energy necessary in some prior art devices, they employ complex fluidic circuits, including a plurality of fluidic timing circuits, flip-flops, one-shot devices, OR gates and the like. Such complex fluidic circuitry increases the initial cost of the therapeutic device and requires costly maintenance by skilled technicians.

SUMMARY OF THE INVENTION

In view of the foregoing limitations and shortcomings of the prior art devices, as well as other disadvantages of those devices not specifically mentioned above, it should be apparent that there still exists a need in the art for a simple yet effective method and apparatus for controlling the pressure in an inflatable therapeutic device so as to generate a venous pumping action. It is, therefore, a primary objective of this invention to fulfill that need by providing a single, simple fluidic device which is capable of controlling the inflation and deflation of a plurality of bladders or cuffs disposed about one or both legs of a patient to produce alternating peak and null pressures in adjacent bladders.

More particularly, it is an object of this invention to improve existing therapeutic intermittent and/or sequential pneumatic compression devices by producing a superior venous pumping system alternative to sequential (peristaltic) pneumatic compression in a cost effective manner using a single fluidic control device rather than the complex and expensive electromechanical and fluidic control units of the prior art.

It is another object of the present invention to provide an inflatable therapeutic device of the type described that may be fabricated with a minimum number of components of sufficiently low cost that the device may be disposed of after use on one patient.

Another object of the present invention is to provide an inflatable therapeutic device that includes a plurality of inflatable bladders connected in two parallel sets so that stable operation is achieved in a minimum time with a single fluidic control element.

Yet another object of the invention is to provide a single fluidic control unit for an inflatable therapeutic device with a plurality of bladders in which pressure, venting and timing of bladder inflation are precisely and independently controllable to achieve the optimum therapeutic benefit of the device.

It is a further object of this invention to provide a fluidic control unit for an inflatable therapeutic device wherein the control unit is not susceptible to jamming or sticking because of mechanical interference or fluid contamination.

Still another object of the present invention is to provide an inflatable therapeutic device of such simple and reliable construction that the need for skilled operators and maintenance technicians is eliminated.

Yet another object of the invention is to provide an inflatable therapeutic device having a plurality of bladders and a fluidic inflation/deflation control unit connected together for pumping operation with a minimum of tubing and only one pneumatic inlet/outlet fitting connected to each bladder.

According to its apparatus aspects, the present invention comprises a pressurized fluid source, preferably an air supply, which may be a portable tank supplying air at a relatively low constant pressure. The air supply is connected by flexible conduit, such as plastic tubing, to the input of a fluidic control unit which has two outputs. A flexible tube or hose is connected to each output and each tube is connected by a single pneumatic fitting to alternate ones of a plurality of inflatable chambers or bladders adapted to wrap around the upper and/or lower leg (thigh and calf) of a patient. Preferably, the chambers are arranged in two sleeves, one upper sleeve for the thigh with four interconnected, independently inflatable chambers and one lower sleeve for the calf with six interconnected, independently inflatable chambers.

A first output of the fluidic control unit is connected by a first one of the flexible tubes to alternate ones of the chambers of the upper and lower sleeves, e.g., the first and third chambers of the upper sleeve and the first, third and fifth chambers of the lower sleeve. The other or second output of the fluidic control unit is connected via the other or second flexible tube to alternate ones of the chambers of the upper and lower sleeves, e.g., the second and fourth chambers of the upper sleeve and the second, fourth and sixth chambers of the lower sleeve. When low pressure air is initially supplied to the control unit, in a first condition of operation, air flows through the first output and the chambers connected to the first flexible tube are inflated in parallel to a predetermined low pressure (1–2 psi) and the chambers connected via the second flexible tube second output are in their initial deflated condition. Thus, all the chambers connected to the first flexible tube are at peak pressure and the alternating chambers connected to the second flexible tube are at a null or substantially zero pressure.

In a second condition of operation of the control unit, air flows through the second output whereby the chambers connected to the second flexible tube are inflated in parallel to a predetermined low pressure (1–2 psi). The chambers connected to the first flexible tube are simultaneously vented to atmosphere through the first flexible tube, the first output and a first vent port in the body of the control unit. The control unit then returns to the first condition of operation whereby the chambers connected to the first output via the first flexible tube are again inflated in parallel and the chambers connected to the second output via the second flexible tube are vented to atmosphere via the second flexible tube, second output and a second vent port in the body of the control unit. By the end of this operating cycle a stable pumping action is achieved. This pumping action is described herein as "alternating chamber pumping."

The control unit is switched between the first and second conditions of operation by a fluidic flip-flop, the peak pressure and timing interval between switching being adjustable by means of adjustment screws which control the cross-sectional area of the flow passages in the flip-flop. Although the fluidic flip-flop control unit is capable of achieving alternating chamber pumping of the inflatable chamber arrangement described above, at the very low pressures of operation of the apparatus (preferably 1.0 to 2.0 psi), it is difficult to vent the chambers to a pressure lower than about 0.25 psi. Most effective therapeutic operation is, of course, achieved by venting the chambers to as nearly zero pressure as possible, e.g., less than about 0.05 psi, since any residual pressure in the inflatable chambers will tend to constrict the veins and thereby inhibit venous blood flow.

In the preferred form of the invention, a pair of diaphragm valves are incorporated in the fluidic control unit to improve the venting of the chambers to a null or substantially zero pressure, i.e., less than about 0.05 psi. The pressure profile generated in each chamber by the fluidic control unit of the invention is a generally saw-tooth waveform. Each output from the preferred control unit charges or inflates the chambers connected to that output from zero or minimum pressure to a peak pressure of about 1.0–2.0 psi in about 7.5–10 seconds. Ideally, of course, venting of the chambers to null or minimum pressure occurs instantaneously, but typically occurs in less than about 3–4 seconds.

The above-described saw-tooth pressure profile of the chambers when inflated by the preferred control unit of the invention has provided improved results during actual testing when compared with the pressure profiles of prior art devices. The saw-tooth pressure profile is also superior to a substantially sinusoidal pressure profile as disclosed in U.S. Pat. No. 3,862,629 since it has been found experimentally to be necessary to drop bladder pressures after inflation as quickly as possible to maximize venous flow. Blood velocity and volumetric flow are significantly improved over the prior art devices, including sequentially operated peristaltic pumping type devices.

According to the method aspects of the invention, a therapeutic application of alternating pressure to the leg of a patient is accomplished by inflating in parallel alternate bladders of a series of inflatable bladders disposed about and spaced along the leg and by simultaneously deflating in parallel the other bladders of the series and then, after a given time period, deflating in parallel the previously inflated bladders of the series and simultaneously inflating the previously deflated bladders of the series and so on.

With the foregoing and other objects, advantages and features of the invention that will become hereinafter apparent, the nature of the invention may be more clearly understood by reference to the following detailed description of the invention, the appended claims and the attached drawings.

BRIEF DESCRIPTION OF THE DRAWINGS

FIG. 1 is a schematic diagram of an application of the present invention in a therapeutic device;

FIG. 3 is a schematic cross-sectional view of the fluidic control unit of the present invention in a first condition of operation;

FIG. 4 is a schematic cross-sectional view of the fluidic control unit of the present invention in a second condition of operation;

FIG. 5 is a graph illustrating the typical pressure profile of the chambers of the therapeutic device shown in FIG. 2.

DETAILED DESCRIPTION OF THE INVENTION

Figure 2:
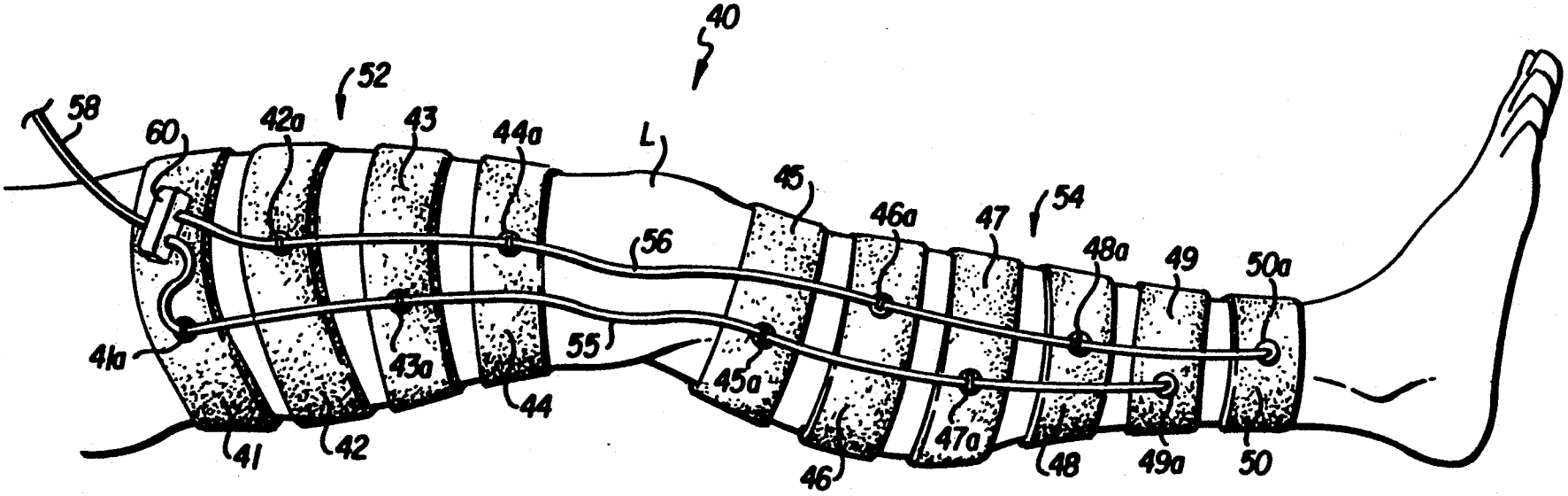
FIG. 2 is a perspective view illustrating the application of the invention in a therapeutic device for applying alternating pressure to the upper and lower portions (thigh and calf) of the leg of a patient.

Referring now in detail to the drawings, there is illustrated in the schematic diagram of FIG. 1 an application of the present invention in a therapeutic device designated generally by reference numeral 10 for applying alternating chamber pumping to the body of a patient. The therapeutic device 10 comprises a pressurized fluid source 12 which may be a low pressure air line, a pressurized gas cylinder, a small portable air pump, or the like. If necessary, a pressure regulator 14 may be used to regulate the pressure from the source, in the case of air, to a preferred pressure of about 10 psi.

The low pressure output from pressure regulator 14 is delivered via line 16 to the input of the fluidic control unit 18 which may be a bi-stable fluidic flip-flop. Flip-flop 18 has two outputs 20, 22 and two vents 21, 23. The outputs 20, 22 are connected by lines 24, 26, respectively, to one or more inflatable bladders or chambers 28, 30. The chambers 28, 30 may be a plurality of annular or torroidal bladders or cuffs adapted to be disposed about the leg or legs of a patient as shown, for example, in FIG. 2.

In a first condition of operation, the flip-flop 18 supplies low pressure air via output 20 and line 24 to the inflatable chamber(s) 28 and inflatable chamber(s) 30 remain deflated at zero pressure. When the pressure in chamber 28 reaches a predetermined peak, e.g., 1.0–1.25 psi, and is sensed by the flip-flop 18 from the line 24, the flip-flop 18 switches to a second condition of operation and supplies low pressure air to output 22 and line 26 to inflate chambers 30. The inflated chambers 28 are then vented to atmosphere via line 24 and vent 21 and deflate to a low pressure. When the pressure in inflatable chambers 30 reaches the predetermined peak, that pressure is sensed in line 26 by the flip-flop 18 which switches to the first condition of operation and the cycle is repeated. If the inflatable chambers 28, 30 in a toroidal form are arranged alternately along the leg of a patient as shown and described below in connection with FIG. 2, the application of pressure to the chambers by the single flip-flop 18 as described above will result in the application of alternating compression to the leg of the patient.

Referring now to FIG. 2 there is shown a specific embodiment of a therapeutic device 40 for applying alternating compression to the leg L of a patient. In the embodiment shown, the device 40 comprises a plurality of annular or toroidal inflatable bladders or cuffs 41–50 in first and second bladder groups 52, 54. The first group 52 includes four bladders 41–44 and the second group 54 includes six bladders 45–50. It will be appreciated that other combinations and shapes of bladders may be used depending on the particular purpose for which the device 40 is to be used.

Each of the bladders 41–50 has a single air inlet/outlet fitting **41*a*–50*a* to which a respective flexible tube 55, 56 is connected. It will be noted that alternate ones of the bladders are connected to a respective tube so that all the bladders identified by odd reference numerals, i.e., 41, 43, 45, 47, 49, are connected to flexible tube 55 by means of their respective inlet/outlet fittings 41*a*, 43*a*, 45*a*, 47*a*, 49*a*. Similarly, those bladders identified by even reference numerals, namely, 42, 44, 46, 48, 50 are connected to flexible tube 56 via their respective fittings 42*a*, 44*a*, 46*a*, 48*a*, 50*a***.

Bladders 41, 43, 45, 47, 49 are thus connected in parallel with each other as are bladders 42, 44, 46, 48, 50 so that the introduction of a pressurized fluid into either tube 55 or 56 will simultaneously inflate in parallel all the bladders connected to that tube. If pressure is applied to only one tube, for example, tube 55, then the odd-numbered bladders 41, 43, 45, 47, 49 will be inflated in parallel and the even-numbered bladders 42, 44, 46, 48, 50 will be deflated in parallel to zero or substantially zero pressure. That condition is reversed when pressure is applied to tube 56 and tube 55 is vented as described below. Tubes 55, 56 are connected at their ends to the outputs of a fluidic control unit 60 which may be a fluidic flip-flop 18 as shown and described in connection with FIG. 1. A pressurized fluid, e.g., air, is supplied to the control unit 60 through a line 58. It will be appreciated by those skilled in the art that by periodically switching the supply of pressurized fluid to the tube 55 or 56 and venting the other tube by operation of the flip-flop 60, a venous pumping action superior to the prior art intermittent or peristaltic pumping actions will be applied to the leg L of the patient.

In another arrangement of the therapeutic device 40 of FIG. 2, the two outputs of the fluidic control unit 60 can be connected via tees in the tubes 55 and 56 between the two bladder groups 52, 54. Shut-off valves can be arranged in the tubes 55, 56 between the outputs and the two bladder groups so that, if desired, the device 40 can be operated to apply alternating pressure to the upper leg (thigh) only, to the lower leg (calf) only or to both the upper and lower leg concurrently as in the FIG. 2 embodiment.

Although the single fluidic flip-flop 18 of FIG. 1 is capable of generating alternating pressure in a therapeutic device, such as that shown in FIG. 2, the arrangement of FIG. 1 is limited to some extent in that it is difficult to vent the chambers 28, 30 to a substantially zero pressure through the vents 21, 23 of the flip-flop 18. In actual testing, the minimum pressure attainable upon venting was observed to be about 0.25 psi. Since such residual pressure will, to some extent, interfere with optimum operation of the therapeutic device by maintaining a slight constriction of the veins, it is preferred that the fluidic control unit be designed to provide venting means that will insure that the inflatable chambers can be vented to a very low or virtually zero pressure, i.e., a pressure less than about 0.05 psi.

FIGS. 3 and 4 illustrate a preferred embodiment of the fluidic control unit of the invention that includes venting means capable of venting the inflatable chambers to a pressure of less than about 0.05 psi. The preferred fluidic control unit 70 is shown in its two operating states in FIGS. 3 and 4, respectively. Referring first to FIG. 3, control unit 70 comprises a body 72 which is preferably injection molded in a plurality of snap-together pieces from a rigid thermoplastic resin. A pair of diaphragm valves 74, 76, both preferably molded in one piece from an elastomeric material are located inside the body 72 and provide the necessary venting as will be described hereinafter.

The body 72 is provided with first and second output ports 78, 80 and an inlet port 82 to which a constant low pressure fluid source, such as a 10 psi air source (not shown), is connected. From the inlet port 82, the air flows into chambers 83, 85 via two passageways 84, 86 and into the central channel 88 of a fluidic bi-stable flip-flop 90 which may be integrally formed in the body 72. Flip-flop 90 also includes channels 92, 94 which are connected via passageways 96, 98 to a respective output port 78, 80 and channels 100, 102 which are connected via passageways 104, 106 to diaphragm chambers 108, 110 beneath the elastomeric diaphragm 75, 77 of valves 74, 76.

Vent ports 112, 114 are formed in the body 72 and communicate with diaphragm chambers 116, 118 above the elastomeric diaphragms 75, 77, respectively. The valves 74, 76 are each formed along the longitudinal axis thereof with a pair of coacting valve heads 120, 122 and 124, 126. Valve 74 is axially movable so as to seat against and seal one of two openings 128 or 130 between chambers 83 and 116 and valve 76 is axially movable so as to seat against and seal one of two openings 132 or 134 between chambers 85 and 118. Adjustment means 136, 138, 140, 142 are provided in a respective passageway 84, 86, 96, 98 to vary the flow rates therethrough and thereby vary the push air pressure delivered to the output ports 78, 80 and the timing of the operating cycle of the flip-flop 90. Adjustment means 136–142 comprise cylindrical plugs with through bores and are rotatable about their axes to vary the size of the respective passageway in which they are located.

Assuming the output ports 78, 80 of the fluidic control unit 70 are connected to a respective tube 55, 56 of the therapeutic device 40 of FIG. 2, the operation of the device commences when a source of low pressure air is supplied to inlet port 82. In the first state or condition of operation shown in FIG. 3, air flows into channel 88 of flip-flop 90 and into chambers 83 and 85 via passageways 84, 86. The flip-flop 90 is shown stabilized in the state in which output channel 100 is pressurized, i.e., at full pressure, and output channel 102 is at zero pressure. Pressure in channel 100 flows through passageway 104 and into chamber 108 to deflect the elastomeric diaphragm 75 and urge the valve 74 upwardly to seat valve head 122 against opening 130 and thus block air flow between the vent 112 and the output port 78. Simultaneously, valve head 120 is unseated from opening 128 to permit flow of air from chamber 83 past valve head 120 to passageway 96 and output port 78. In this position of valve 74, the inflatable bladders connected to output port 78 will be inflated in parallel.

As previously noted, output channel 102 is at zero pressure and diaphragm valve 76 is in its at rest state with valve head 124 seated in opening 132 and valve head 126 unseated from opening 134. In this state, air flow from the chamber 85 is blocked and any air pressure in the inflatable bladders connected to output port 80 is vented to atmosphere via passageway 98, opening 134, chamber 118 and vent 114. Because the inflatable bladders are vented to atmosphere via relatively large passages and openings and does not flow back through flip-flop 90 to a vent (as in flip-flop 18 of FIG. 1), the bladders can be rapidly vented to a substantially zero pressure (less than about 0.05 psi) in 3–4 seconds.

Adjustment means 136, 138 control the air flow rate to the output ports 78, 80 and thus control the time period required to inflate the bladders connected to the output ports. Adjustment means 140, 142 controls the return flow of air to respective return channels 92, 94 which determines the magnitude of pressure at which the flip-flop 90 will change its state, i.e., switch the air flow from channel 100 to channel 102 and vice versa. The pressure point for the change of state of the flip-flop 90 also determines the peak pressure attained at the output ports 78, 80 and thus in the bladders.

It will be appreciated that it would be possible to construct the control unit 70 with orifices of a predetermined size in lieu of the, adjustment means 136–142 once an optimum peak pressure and timing cycle are established for a given system or therapeutic procedure.

When the set point pressure is reached at output port 78, the flip-flop 90 switches the flow from channel 100 to channel 102 in response to the pressure in channel 92 thereby causing the control unit 70 to shift to its second operating state shown in FIG. 4. In the second operating state, diaphragm valve 74 returns to its at rest state as pressure bleeds from chamber 108 via passageway 104 and channel 100. The resilient force of the elastomeric diaphragm 75 also aids in returning valve 74 to its rest state. In the at rest state of diaphragm valve 74, valve head 122 is unseated from opening 130 permitting the air pressure in the bladders connected to the output port 78 to vent to atmosphere through passageway 96, opening 130, chamber 116 and vent 112. Simultaneously, valve head 120 seats against opening 128 thereby blocking air flow from the air source to the output port 78.

Flow of low pressure air through channel 88, channel 102, passageway 106 and into chamber 110 urges diaphragm valve 76 upwardly to seat valve head 126 in opening 134 and thereby block of vent 114 from passageway 98. Valve head 124 simultaneously unseats from opening 132 permitting flow of air from the source through inlet port 82, passageway 86, chamber 85, past valve head 124, through passageway 98 and output port 80 to the set of inflatable bladders connected thereto. When the bladder set reaches it preset peak pressure the pressure in return channel 94 switches the flow of air in flip-flop channel 88 back to channel 100 and the cycle is repeated.

Referring now to the graph of FIG. 5 there is depicted a typical pressure profile of two alternate bladders 41, 42 of the therapeutic device shown in FIG. 2 in which the fluidic control unit 70 of FIGS. 3 and 4 has been incorporated. In the pressure profile shown, the adjustment means 136–142 have been set to provide a peak pressure in the bladders 41–50 of 1.2 psi which takes 10 seconds to attain. At peak pressure (elapsed time 10 seconds) the flip-flop 90 of the fluidic control unit switches to its other state to commence venting bladder 41 and inflating bladder 42 (dashed line). Bladder 41 vents to a pressure of 0 psi in about 3.5 seconds. At about 12.5 seconds elapsed time, the increasing pressure in bladder 42 surpasses the decreasing pressure in bladder 41 and increases to a peak pressure of 1.2 psi in 10 seconds (20 seconds elapsed time) when bladder 41 is at zero pressure. The saw-tooth pressure profile of the bladders 41–50 typically shown in FIG. 5 advantageously exerts an alternating pressure upon the leg or other extremity about which the bladders are disposed.

Figure 6:
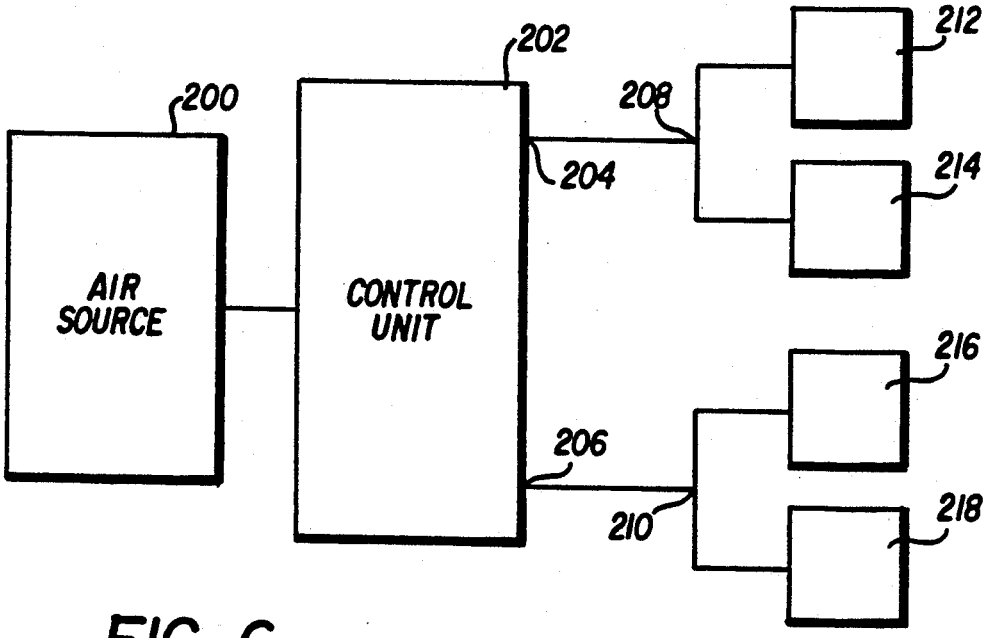
FIGS. 6 and 7 are schematic diagrams illustrating alternative configurations of the present invention for connection to a pair of therapeutic devices of the type shown in FIG. 2.
Figure 7:
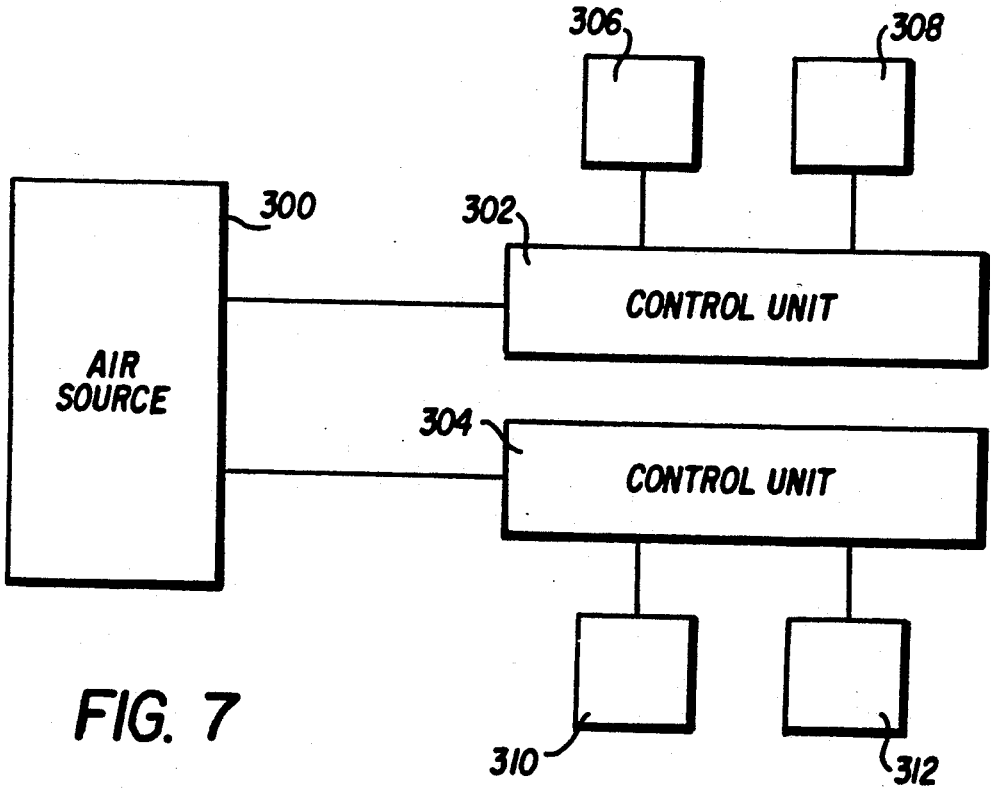

FIGS. 6 and 7 illustrate arrangements in which a therapeutic device, for example, of the type shown in FIG. 2, is applied to both legs or other extremities of a patient. In FIG. 6 an air source 200 supplies a single fluidic control unit 202 which may be of either the type shown as flip-flop 18 of FIG. 1 or the fluidic control unit 70 of FIGS. 3 and 4. The two outputs 204, 206 of unit 202 are divided by tees 208, 210 so as to supply from tee 208 odd-numbered bladders 212 on the right leg and odd-numbered bladders 214 on the left leg and to supply from tee 210 even-numbered bladders 216 on the right leg and even-numbered bladders 218 on the left leg.

In the alternate embodiment of FIG. 7 an air source 300 supplies two separate fluidic control units, 302, 304, each of which supplies the respective alternately inflated bladders 306, 308 on one leg or limb and 310, 312 on the other leg or limb.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. A therapeutic device for producing alternating pressure to portions of the human body comprising:

a source of pressurized fluid;

first and second sets of inflatable chambers, each set comprising at least two chambers; and fluid control means comprising only one fluidic flip-flop connected between said pressurized fluid source and said first and second sets of inflatable chambers for supplying pressurized fluid alternately to said first and second sets of inflatable chambers and for exhausting pressurized fluid alternately from said first and second sets of inflatable chambers whereby alternating chamber pumping is produced by the therapeutic device.

2. A therapeutic device according to claim 1, wherein said fluidic flip-flop has first and second pressurized fluid outputs and first and second vent ports, a first tube connected between said first output and each of the chambers of the first set of inflatable chambers, a second tube connected between said second output and each of the chambers of the second set of inflatable chambers, said fluidic flip-flop including means for supplying pressurized fluid alternately to said first and second tubes via said first and second outputs, respectively, and for exhausting pressurized fluid alternately from said first and second tubes via said first and second vent ports, respectively.

3. A therapeutic device according to claim 1, including third and fourth sets of inflatable chambers, each set comprising at least two chambers, and a second fluid control means comprising only one fluidic flip-flop connected between said pressurized source and said third and fourth sets of inflatable chambers for supplying pressurized fluid alternately to said third and fourth sets of inflatable chambers and for exhausting pressurized fluid alternately from said third and fourth sets of inflatable chambers.

4. A therapeutic device according to claim 1, wherein said first and second sets of inflatable chambers comprise annular bladders, each set comprising two groups of annular bladders, a first group of said bladders being adapted to encircle the upper leg of a human and a second group of said bladders being adapted to encircle the lower leg of a human.

5. A therapeutic device according to claim 4, wherein each of said bladders has only one inlet/outlet means for introducing pressurized fluid into the bladder and for exhausting pressurized fluid from the bladder.

6. A therapeutic device according to claim 1, wherein said fluid control means comprises:

a control unit body, said one fluidic flip-flop being disposed in said body, said body having an inlet port connected to said pressurized fluid source, first and second outlet ports each connected to a respective one of said first and second sets of inflatable chambers, and first and second vent ports; and first and second valve means operatively associated with said one fluidic flip-flop for controlling the flow of pressurized fluid from said inlet port to said outlet ports and from said outlet ports to said vent ports.

7. A therapeutic device according to claim 6, wherein each of said first and second valve means comprises a pair of coacting valve heads.

8. A therapeutic device according to claim 7, including first and second passageways connecting the inlet port to a respective first and second output port, first and second openings connecting said first and second passageways respectively with said first and second vent ports, the coacting valve heads of said first valve means being operative in response to said flip-flop to open said first passageway and close said first opening in an inflate position of said first valve means and to close said first passageway and open said first opening in an exhaust position of said first valve means, the coacting valve heads of said second valve means being operative in response to said flip-flop to open said second passageway and close said second opening in an inflate position of said second valve means and to close said second passageway and open said second opening in an exhaust position of said second valve means.

9. A therapeutic device according to claim 8, wherein said first and second valve means are operated by said flip-flop such that when the first valve means is in its inflate position the second valve means is in its exhaust position.

10. A therapeutic device according to claim 8, including adjustment means disposed in said first and second passageways for controlling the rate of flow of pressurized fluid to the first and second output ports whereby the time period for inflating the inflatable chambers is controllable.

11. A therapeutic device according to claim 9, including first and second diaphragm chambers in said body, said first and second valve means each comprising a diaphragm valve disposed in a respective one of said first and second diaphragm chambers.

12. A therapeutic device according to claim 11, including third and fourth passageways connecting said flip-flop to a respective first and second diaphragm chamber for alternately shifting said first and second valve means between their respective inflate and exhaust positions.

13. A therapeutic device according to claim 8, including first and second return channels in said flip-flop each connected by a passage to a respective one of said first and second output ports and adjustment means in each passage for controlling the rate of return flow of pressurized fluid to said flip-flop whereby the magnitude of peak pressure in the inflatable chambers and the pressure at which the flip-flop changes state are determined.

14. A therapeutic device according to claim 6, wherein said control unit body and valve means comprise a plurality of components molded of plastic or elastomeric materials or both and adapted to be connected together into a unitary body.

15. A therapeutic device for producing alternating pressure to portions of the body of a patient comprising:

a source of pressurized fluid;

at least two sets of inflatable bladders, each set including a plurality of bladders, the bladders of one set being alternately arranged with the bladders of the other set, each bladder having only one inlet/outlet means for introducing and exhausting the pressurized fluid;

a first tube connected to the inlet/outlet means of all the bladders of one set;

a second tube connected to the inlet/outlet means of all the bladders of the other set; and fluid control means connected to said first and second tubes for supplying pressurized fluid alternately to the bladders of said one set and then to the bladders of said other set and for exhausting pressurized fluid alternately from the bladders of said one set and then from the bladders of said other set.

16. A therapeutic device according to claim 15, wherein said fluid control means comprises only one bi-stable flip-flop connected between said pressurized source and said first and second tubes.

17. A therapeutic device according to claim 16, including means associated with said flip-flop for adjusting the peak pressure supplied to said bladders from said pressurized source and means associated with said flip-flop for adjusting the time required to inflate the bladders to said peak pressure.

18. A therapeutic device according to claim 17, wherein said adjustment means each comprise an orifice of predetermined size.

19. A method of producing alternating pressure to therapeutically treat portions of the body of a patient comprising the steps of:

providing a source of pressurized fluid;

providing at least two sets of a plurality of inflatable bladders;

arranging said bladders on the portion of the patient to be therapeutically treated such that the bladders of one set alternate with the bladders of the other set;

connecting a single fluidic flip-flop between the pressurized source and said two sets of bladders;

operating said flip-flop to simultaneously supply the pressurized fluid to all the bladders of one set and vent pressurized fluid from all the bladders of the other set;

then operating said flip-flop to simultaneously supply the pressurized fluid to all the bladders of said other set and vent pressurized fluid from all the bladders of said one set.

20. A method according to claim 19, including the steps of arranging the bladders of said one set on the upper leg and lower leg of the patient and arranging the bladders of said other set on the upper leg and lower leg of the patient.

* * * * *